US012677926B2

(12) United States Patent
Pearse

(10) Patent No.: US 12,677,926 B2
(45) Date of Patent: Jul. 14, 2026

(54) SYSTEM TO DISPENSE COSMETIC PRODUCTS

(71) Applicant: Jenna Leigh Pearse, Brooklyn, NY (US)

(72) Inventor: Jenna Leigh Pearse, Brooklyn, NY (US)

( * ) Notice: Subject to any disclaimer, the term of this patent is extended or adjusted under 35 U.S.C. 154(b) by 205 days.

(21) Appl. No.: 18/672,317

(22) Filed: May 23, 2024

(65) Prior Publication Data

US 2024/0306792 A1 Sep. 19, 2024

(51) Int. Cl.

| | |
|---|---|
| ***A45D 33/16*** | (2006.01) |
| ***A45D 33/26*** | (2006.01) |
| ***A45D 34/00*** | (2006.01) |
| ***A45D 34/04*** | (2006.01) |
| ***A45D 34/06*** | (2006.01) |
| ***A45D 40/18*** | (2006.01) |
| ***A45D 40/24*** | (2006.01) |
| ***A45D 40/26*** | (2006.01) |

(52) U.S. Cl.

CPC ..... *A45D 33/16* (2013.01); *A45D 33/26* (2013.01); *A45D 34/042* (2013.01); *A45D 34/06* (2013.01); *A45D 40/18* (2013.01); *A45D 40/24* (2013.01); *A45D 40/262* (2013.01); *A45D 2034/005* (2013.01)

(58) Field of Classification Search

CPC ..... A45D 33/00; A45D 33/16; A45D 33/20; A45D 33/26; A45D 34/06; A45D 34/042; A45D 40/00; A45D 40/18; A45D 40/24; A45D 40/262; A45D 2034/005; B65D 5/38; B65D 5/728; B65D 7/10; B65D 9/08; B65D 11/12; B65D 2583/0468; A45C 11/16; A45C 11/008; A61J 1/03; A61J 7/0069; A01K 97/06

USPC ..... 401/118, 123; 206/581, 533, 539

See application file for complete search history.

(56) References Cited

U.S. PATENT DOCUMENTS

| | | | | |
|---|---|---|---|---|
| 6,886,695 | B1 * | 5/2005 | Karoly | A45D 40/24 206/823 |
| 11,751,662 | B2 * | 9/2023 | Cheng | A45D 33/20 206/581 |
| 2003/0035345 | A1 * | 2/2003 | Fernandez | G09B 19/12 368/223 |
| 2014/0238434 | A1 * | 8/2014 | Blanch | A45D 40/24 132/287 |

(Continued)

*Primary Examiner* — Rachel R Steitz
*Assistant Examiner* — Karim Asqiriba

(57) ABSTRACT

Disclosed is a system (100) to dispense cosmetic products. The system (100) comprises a housing (102) and a plurality of cartridges (104) disposed within a periphery of the housing (102). Each cartridge (104) receives a cosmetic product. Each cartridge (104) is selectively movable between a first position proximally to a center of the housing (102) and a second position proximally to the periphery of the housing (102). Further, the system (100) comprises a plurality of applicators (106). Moreover, the system (100) comprises a rotatable selector (108). The rotatable selector (108) enables selection of a cartridge (104). The system (100) also comprises a dispenser (110). The dispenser (110) is connected to each individual cartridge (104) and the rotatable selector (108). Further, operation of the dispenser (110) enables movement of the cartridge (104) selected using the rotatable selector (108) between the first position and the second position.

10 Claims, 2 Drawing Sheets

(56) References Cited

U.S. PATENT DOCUMENTS

| | | | | |
|---|---|---|---|---|
| 2015/0001128 | A1* | 1/2015 | Jaffe | A45C 11/16 206/581 |
| 2016/0338460 | A1* | 11/2016 | Jaffe | A45C 11/16 |
| 2017/0265623 | A1* | 9/2017 | Kamboj | A45D 40/20 |
| 2018/0199690 | A1* | 7/2018 | Steele | A45D 33/006 |
| 2019/0336399 | A1* | 11/2019 | Zonana | A61J 1/03 |
| 2020/0086513 | A1* | 3/2020 | Ambielli | A45C 11/32 |
| 2020/0288840 | A1* | 9/2020 | Al-Sulatieen | A45D 42/00 |
| 2022/0135292 | A1* | 5/2022 | Darst | A61J 7/0084 215/221 |
| 2024/0341448 | A1* | 10/2024 | Morrow | A45D 40/261 |
| 2025/0229953 | A1* | 7/2025 | Wang | B65D 43/22 |
| 2025/0332069 | A1* | 10/2025 | Darst | A61J 7/04 |

* cited by examiner

SYSTEM TO DISPENSE COSMETIC PRODUCTS

TECHNICAL FIELD

The present disclosure generally relates to personal care systems. Particularly, the present disclosure relates to systems to dispense cosmetic products.

BACKGROUND

Usually, various types of cosmetic products such as liners, concealers, mascara, lipsticks, lip balms, nail paint and the like have been used by people on a daily basis. Generally, users of such cosmetic products are required to carry individual containers containing the various types of cosmetic products. Additionally, users of such cosmetic products are required to carry applicators including different types of brushes, sponges, tubes and the like, along with one or more mirrors to enable the users to conveniently view their reflections while accurately applying the cosmetic products. Moreover, the users may be required to carry solvents, removers and the like to further assist the users in convenient dispensation and application of the cosmetic products.

It will be appreciated that carrying such a wide variety of individual containers comprising the different types of cosmetic products is highly inconvenient for most users. For example, many of the containers may comprise a pump enable convenient dispensation and subsequent application of the cosmetic products. However, when such containers are carried, such as, in a small handbag, the pump may get accidentally pressed, thereby, causing unrequired dispensation and spillage of the respective cosmetic product. Similarly, the container may comprise a lid thereon to prevent accidental spillage of the cosmetic product contained in the respective container. However, the lid may be accidentally opened or broken, thus, leading to unrequired dispensation and wastage of the respective cosmetic product. Additionally, users carrying such numerous individual containers may forget to carry one or more essential cosmetic products or may misplace one or more of the individual containers having costly cosmetic products therein, thus, leading to inconvenience and/or losses for the users.

In light of the above discussion, it can be readily realized that there exists an urgent need for improved systems to enable users to carry, dispense and use different types of cosmetic products in a convenient manner.

SUMMARY

The present disclosure provides a system to dispense cosmetic products. The system comprises a housing and a plurality of cartridges disposed within a periphery of the housing. Each cartridge receives a cosmetic product. Each cartridge is selectively movable between a first position proximally to a center of the housing and a second position proximally to the periphery of the housing. Further, the system comprises a plurality of applicators. Each applicator is connected to an individual cartridge of the plurality of cartridges to enable application of the cosmetic product stored in the respective cartridge. Moreover, the system comprises a rotatable selector disposed proximally to the center of the housing. The rotatable selector enables selection of a cartridge from the plurality of cartridges. The system also comprises a dispenser disposed at the center of the housing. The dispenser is connected to each individual cartridge and the rotatable selector. Further, operation of the dispenser enables movement of the cartridge selected using the rotatable selector between the first position and the second position.

The disclosed system streamlines and customizes application of various cosmetic products through a housing equipped with different applicators connected to the plurality of cartridges, allowing users to precisely and efficiently apply specific cosmetic products. Further, the integration of the rotatable selector enables convenient selection of a desired cosmetic product for application, thereby, providing users easy access to various cosmetic products received within the system without a requirement to carry a plurality of containers. Moreover, the dispenser positioned at the center of the housing facilitates convenient selection of the desired cosmetic product and quick application using the respective applicator. Also, the secure and portable design of the system ensures safe storage and ready accessibility of various cosmetic products as and when needed, thus, enabling users to confidently transport and use various cosmetic products (such as costly and premium cosmetic products) while traveling or on-the-go.

In an embodiment, each cartridge of the plurality of cartridges is detachably received into the housing.

In another embodiment, the housing comprises a plurality of receptacles to receive the plurality of cartridges. Each cartridge comprises a first snap-fit lock and each receptacle comprises a second snap-fit lock. The first snap-fit lock engages with the second snap-fit lock to receive the cartridge into the respective receptacle.

In yet another embodiment, each cartridge is associated with a different cross-section.

In still another embodiment, the cosmetic product is one of: a liquid cosmetic product, a semi-solid cosmetic product, a powder-based cosmetic product.

In an embodiment, the plurality of applicators comprise at least one of: a tube-type applicator, a sponge-type applicator, a brush-type applicator.

In another embodiment, the each applicator is detachably connected to the respective cartridge through a spill-proof valve.

In still another embodiment, the dispenser is one of: a push button, a slider.

In yet another embodiment, the dispenser comprises a mirror thereon. The mirror comprises a slidable cover.

In an embodiment, the system comprises a movement mechanism connected to each individual cartridge, the rotatable selector and the dispenser. The movement mechanism enables movement of the selected cartridge between the first position and the second position upon selection using the rotatable selector and activation of the dispenser.

In another embodiment, the movement mechanism is implemented using one of: a rail guide, a linear bearing, a dovetail slide, a rack and pinion arrangement.

In yet another embodiment, each applicator is stored in a retracted state with respect to the cartridge when the respective cartridge is in the first position. The applicator (106) is released when the cartridge is moved to the second position.

DETAILED DESCRIPTION OF DRAWINGS

Figure 1:
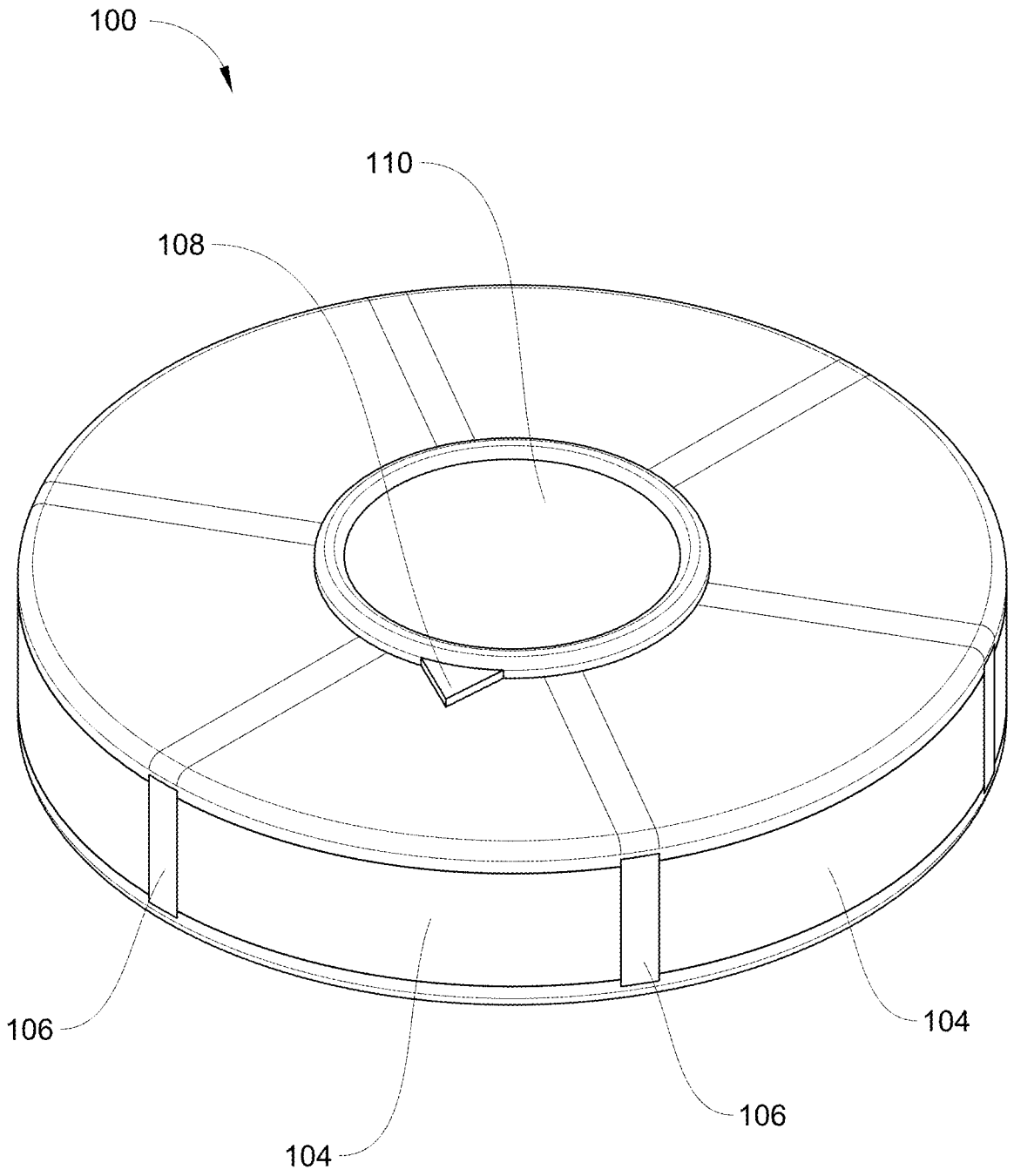
FIG. 1 shows a perspective view of a system to dispense cosmetic products, in accordance with an embodiment of the present disclosure.

Referring to FIG. 1, there is shown a perspective view of a system 100 to dispense cosmetic products, in accordance with an embodiment of the present disclosure. The system 100 enables users to carry a plurality of different cosmetic products in an easy-to-carry and spill-proof manner. Further, the system 100 enables the users to conveniently apply one or more of the different cosmetic products without requiring to carry various applicators to facilitate the application of the cosmetic products, thereby, overcoming one or more problems associated with conventional techniques of carrying, dispensing and applying cosmetic products within individual containers.

The system 100 comprises a housing 102. The housing 102 is a structure of the system 100 that acts as a foundation to enable various other components of the system 100 to be received therein. In an example, the housing 102 is a substantially flat, cylindrical structure having dimensions corresponding to an average human hand to enable users to conventionally hold the system 100 in one hand while using another hand to apply one or more of the cosmetic products carried in the system 100. In another example, the housing is a cubical structure. Optionally, the housing 102 comprises grips or grooves to enable users to conveniently hold the system 100 during usage, thereby, improving ergonomics associated with the system 100. Optionally, a rear side of the housing 102 is covered with a slip-resistant material such as a rubberized coating, a textured surface, a non-slip adhesive pad, an anti-slip tape or a nanocoating to prevent slippage of the housing 102 from hands of the user during usage of the system 100 (for example, when the hands of the user are covered with sweat, grime, dust and the like).

The system 100 further comprises a plurality of cartridges 104 disposed within a periphery of the housing 102. Each cartridge 104 serves as an individual reservoir for receiving and storing a specific cosmetic product. Further, each cartridges 104 is selectively movable between a first position proximally to a center of the housing 102 and a second position proximally to the periphery of the housing 102. Such an arrangement enables efficient utilization of space within the housing 102 while enabling user access to various cosmetic products. Further, the movement of the cartridges 104 between the first position and the second position allows users to conveniently select and apply a desired cosmetic product without need to find, select and extract separate containers (such as, from a handbag or a makeup kit). Further, each cartridge 104 is capable of receiving a different cosmetic product as per user preferences. For example, the cartridges 104 may receive a foundation, a concealer, a blush, an eyeshadow, a lipstick, a lip gloss, a highlighter, a nail paint, a makeup remover and the like. Alternatively, one or more cartridges 104 may receive the same cosmetic product, such as, based on frequency of use of a cosmetic product by the user. Moreover, each cartridge 104 securely stores the respective cosmetic product, thereby, preventing leakage or contamination of the cosmetic product. The integration of the plurality of cartridges 104 along the inner periphery of the housing 102 optimizes weight distribution within the housing 102, enhancing stability and balance of the system 100 during use. Optionally, each cartridge 104 is integrated with a lid to prevent spillage or contamination when the system 100 is transported. For example, the lids may be opaque to shield the stored cosmetic product from external radiation, such as sunlight or ultraviolet light, thereby preserving integrity of the stored cosmetic products. Additionally, transparent windows may be incorporated into the cartridges 104 to allow the user to monitor the remaining quantity of unused cosmetic product. For example, such a transparent window may comprise a dial or similar indicator to enable the user to accurately determine the amount of cosmetic product remaining in the respective cartridge 104.

Moreover, the system 100 comprises a plurality of applicators 106. Each applicator 106 is connected to an individual cartridge 104 of the plurality of cartridges 104 to enable application of the cosmetic product stored in the respective cartridge 104. Each applicator 106 serves as a tool for transferring the cosmetic product from the cartridge 104 onto the user (such as, onto skin of the user, nails of the user, hair of the user and the like), thus allowing precise and controlled application of the cosmetic products. Such a direct connection between the cartridge 104 and the respective applicator 106 ensures efficient and direct transfer of the cosmetic product, improve user access to the stored cosmetic products and ensuring minimum loss of the stored cosmetic products. In one example, the plurality of applicators 106 comprise a dense brush, a sponge, a fine-tipped brush, a wand, a wand having a doe-foot tip and the like. Optionally, each applicator 106 is incorporated with a removable cover to protect the applicator 106 from damage when not in use. Optionally, each applicator 106 is detachably connected to the respective cartridge 104 to facilitate convenient cleaning and maintenance of the plurality of applicators 106, thereby, ensuring hygiene and longevity of the system 100 and allowing easy replacement of worn-out or deteriorated applicators 106. The system 100 also comprises a rotatable selector 108 disposed proximally to the center of the housing 102. The rotatable selector 108 enables selection of a cartridge 104 from the plurality of cartridges 104. The positioning of the rotatable selector 108 proximally to the center of the housing 102 ensuring uninhibited interaction of the rotatable selector 108 with the plurality of cartridges 104. The rotatable selector 108 enables the user to conveniently select a specific cartridge 104 containing a desired cosmetic product from the plurality of cartridges 104 available within the housing 102. In an example, the rotatable selector 108 incorporates a dial mechanism that visually indicates the selected cosmetic product, thereby, enabling the user to quickly and accurately identify the selected cosmetic product. Optionally, the rotatable selector 108 is detachable from the housing 102, enabling convenient replacement of the rotatable selector 108 having different markings, a different type of visual indicator and the like. In one example, the rotatable selector 108 comprises a ratchet or detent mechanism to provide a haptic feedback to the user in a form of audible feedback (such as clicking sounds) or tactile feedback (such as slight vibrational movement) upon completion of rotation of the rotatable selector 108 by a specific amount.

The system further comprises a dispenser 110 disposed at the center of the housing. The dispenser 110 is connected to each individual cartridge 104 and the rotatable selector 108. Further, operation of the dispenser 110 enables movement of the cartridge 104 selected using the rotatable selector 108 between the first position and the second position. The dispenser 110 serves as a control mechanism by providing users with control over positioning of the cartridges 104 with respect to the center of the housing, thereby, enhancing user experience and enabling efficient access to the desired cosmetic products. For example, pressing and holding the dispenser 110 initiates movement of the cartridge 104 selected using the rotatable selector 108 from a "default state" or "stored state" associated with the first position of the selected cartridge 104 proximally to the center of the housing 102 to a "use state" associated with the second position distally from the center of the housing 102 or proximally to the periphery of the housing 102. Such an operation of the cartridge 104 enable application of the desired cosmetic product using the respective applicator 106. Subsequently, the dispenser 110 may again be used to cause retraction of the cartridge 104 from the second position back to the first position to enable secure storage and transportation of the system 100 without causing damage to or wastage of the plurality of cosmetic products stored within the system 100. Thus, the system 100 enables convenient storage, transportation and usage of one or more desired cosmetic products from a selection of multiple cosmetic products in a convenient and compact manner without necessitating use of multiple containers for each cosmetic product.

In one embodiment, each cartridge 104 of the plurality of cartridges 104 is detachably received into the housing 102. Such detachable receiving of each cartridge 104 into the housing 102 facilitates convenient replacement and customization of the plurality of cartridges 102 by allowing users to quickly swap one or more cartridges 104 with different cartridges associated with different cosmetic products based on a makeup routine and/or changing preferences of the user. Further, the detachable receiving of each cartridge 104 into the housing 102 improves ease of maintenance and hygiene by simplifying cleaning and refilling of each cartridge 104, thereby, improving functionality and prolonging lifespan of the system 100.

In another embodiment, the housing 102 comprises a plurality of receptacles to receive the plurality of cartridges 104. Further, each cartridge 104 comprises a first snap-fit lock and each receptacle comprises a second snap-fit lock. The first snap-fit lock engages with the second snap-fit lock to receive the cartridge 104 into the respective receptacle. It will be appreciated that a shape of a receptacle of the plurality of receptacles corresponds to a shape of a cartridge that is received into the receptacle. Further, the incorporation of the first snap-fit lock into each cartridge 104 and the second snap-fit lock into each receptacle ensures a secure and snug fit of the cartridge 104 into the respective receptacle, thereby, ensuring convenient detachment of the cartridge 104 from the receptacle as and when needed as well as preventing unexpected dislodgement of the cartridge 104 from the receptacle. In one example, the first snap-fit lock and the second snap-fit lock resemble interlocking tabs or protrusions on the cartridges 104 and receptacles. Optionally, the first snap-fit locks on the plurality of cartridges 104 correspond to a male element and the second snap-fit locks on the receptacles correspond to a female element, such that the male elements are received into the female element to ensure secure locking of the first snap-fit lock with the second snap-fit lock.

In yet another embodiment, each cartridge 104 is associated with a different cross-section. Such a different cross-section of each cartridge 104 enables accommodation of different volumes of the cosmetic products into the system 100, thereby, ensuring optimal utilization and efficiency of the cosmetic products. For example, the cartridges 104 associated with frequently used cosmetic products have larger cross-sections, thus, providing increased volumes to store larger quantities of the respective cosmetic products. Conversely, the cartridges 104 associated with less frequently used products have smaller cross-sections, thereby, minimizing wastage of space within the housing 102.

In still another embodiment, the cosmetic product is one of: a liquid cosmetic product, a semi-solid cosmetic product, a powder-based cosmetic product. For example, the liquid cosmetic products include, but are not limited to, a foundation, a concealer, an eyeliner, a lip gloss, and a liquid highlighter. In another example, the semi-solid cosmetic products include, but are not limited to, a cream blush, a lipstick in a cream formula, a gel eyeliner, a cream eyeshadow and a stick highlighter. In yet another example, the powder-based cosmetic products include, but are not limited to, a loose setting powder, a pressed powder foundation, eyeshadow palettes, a bronzer and a blush. The system 100 enables to store such different cosmetic products in various physical states, thereby, ensuring that users have access to desired cosmetic products in various preferred formulations, thus, allowing customization and personalization of looks achieved through application of the cosmetic products.

In an embodiment, the plurality of applicators 106 comprise at least one of: a tube-type applicator, a sponge-type applicator, a brush-type applicator. The tube-type applicators and the sponge-type applicators can be employed for precise and controlled application of liquid or semi-solid cosmetic products whereas the brush-type applicators can be used for convenient blending of various semi-solid or powder-based cosmetic products or different types of cosmetic products (such as liquid with semi-solid cosmetic products or semi-solid with powder-based cosmetic products). In one example, the tube-type applicators can be used for application of concealer, lip gloss, liquid eyeliner, liquid highlighter or liquid blush. In another example, the brush-type applicators can be used for application of powder foundation, eyeshadow, blush, bronzer or highlighter.

In another embodiment, each applicator 106 is detachable connected to the respective cartridge 104 through a spill-proof valve. The spill-proof valves accommodated with each cartridge 104 enable to prevent accidental spillage or leakage of the cosmetic products from the cartridges 104, thereby, preserving cleanliness and integrity of the system 100. In one example, the spill-proof valve is integrated as a spring-loaded mechanism that automatically seals the opening when the respective applicator 106 is extended for use, thus, preventing excess cosmetic product from leaking from the between the applicator 106 and the cartridge 104. In another example, a silicone or rubber gasket is integrated into the plurality of cartridges 104. Such gaskets form a tight seal with the opening to contain the cosmetic product securely within the respective cartridge 104. Optionally, a labyrinth-style valve comprising a series of baffles or channels is integrated into the housing 102. Such a labyrinth-style valve enables to redirect any spilled cosmetic product back into the respective cartridge, thereby, reducing spillage of the various cosmetic products from the system 100.

In still another embodiment, the dispenser 110 is one of: a push button, a slider. The implementation of the dispenser 110 as the push button reduces an amount of effort required of the user to extend the selected cartridge 104 from the first position to the second position or to retract the selected cartridge 104 from the second position to the first position. Moreover, the implementation of the dispenser 110 as the slider enables the user to control an amount of extension and/or retraction of the selected cartridge 104. For example, a user may choose to only partially extend a cartridge, such as a cartridge employed for storing lip gloss while choosing to completely extend a different cartridge, such as a cartridge used for storing eyeliner. In such an example, the implementation of the dispenser 110 as the slider enables the user to conveniently extend the different cartridges by various desired amounts.

In an embodiment, the dispenser 110 comprises a mirror thereon. The mirror comprises a slidable cover. The integration of the mirror on the dispenser enables convenient on-the-go touch-ups and application of cosmetic products. Moreover, the mirror is provided with the slidable cover for increased protection of the mirror against scratches and damage when the system 100 is not in use. Optionally, the mirror is incorporated with a slider or wiper mechanism that enables quick and efficient removal of fingerprint smudges, thereby maintaining optimal clarity for precise application of the cosmetic products and increasing usability and longevity of the mirror.

In another embodiment, the system 100 comprises a movement mechanism connected to each individual cartridge 104, the rotatable selector 108 and the dispenser 110. The movement mechanism enables movement of the selected cartridge 104 between the first position and the second position upon selection using the rotatable selector 108 and activation of the dispenser 110. For example, when the user selects a specific cartridge 104 using the rotatable selector 108 and subsequently, presses the dispenser 110, the movement mechanism shifts the selected cartridge 104 from the first position proximally to the center of the housing 102 to the second position proximally to the periphery of the housing 102. Similarly, the movement mechanism enables the user to easily retract the extended cartridge 104 from the second position back to the first position subsequent to usage of the desired cosmetic product, thereby, enabling quick and efficient storage of the system 100 after usage. Optionally, the movement mechanism is adjustable to enable users to adjust a speed or intensity of the movement of the cartridge from the first position to the second position, allowing personalization for the users according to individual preferences.

In yet another embodiment, the movement mechanism is implemented using one of: a rail guide, a linear bearing, a dovetail slide, a rack and pinion arrangement. For example, the implementation of the movement mechanism as the rail guide offers precise linear movement of the plurality of cartridges 104 along a fixed track, ensuring smooth and accurate positioning of the cartridges 104. In another example, the implementation of the movement mechanism as the linear bearing facilitates frictionless movement of the cartridges along a linear axis. In yet another example, the implementation of the movement mechanism as the dovetail slide mechanism enables sturdy and reliable movement of the plurality of cartridges 104 through interlocking grooves and ridges, thereby, ensuring robust and durable operation of the system 100. In still another example, the implementation of the movement mechanism as the rack and pinion arrangement provides efficient linear movement by converting rotational motion into linear motion, thus enabling convenient and accurate repositioning of the plurality of cartridges 104.

In still another embodiment, each applicator 106 is stored in a retracted state with respect to the cartridge 104 when the respective cartridge 104 is in the first position. The applicator 106 is released when the cartridge 104 is moved to the second position. For example, the storage of each applicator 106 in the retracted state ensures compact and efficient storage of the plurality of applicators 106 within the housing 102, thereby, minimizing clutter and optimizing space utilization. For example, the user can perform a clicking action to cause the applicator 106 to swiftly close and store the applicator 106 after usage, enabling a quick and hassle-free solution for post-application clean-up and organization. Similarly, when the applicator 106 is required to be used, the applicator 106 is effortlessly released from the retracted position to enable instant application of the respective cosmetic product. For example, each applicator 106 is disposed with a spring-loaded mechanism within the housing 102 that enables both the release and retraction functions of the plurality of applicators 106. In such an example, when the cartridge 104 is moved from the first position to the second position, the spring mechanism disengages to allow the applicator 106 to extend outward for user convenience. Conversely, when the cartridge 104 is returned to the first position after application of the respective cosmetic product, the spring-loaded mechanism retracts the applicator 106 back into the stored position, thereby ensuring compact and secure storage of the applicator 106 within the housing 102. Thus, the spring-loaded mechanism enables to reliably and efficiently integrate the storage and release of the plurality of applicators 106 within the housing 102, thereby, enhancing user experience and usability.

Figure 2:
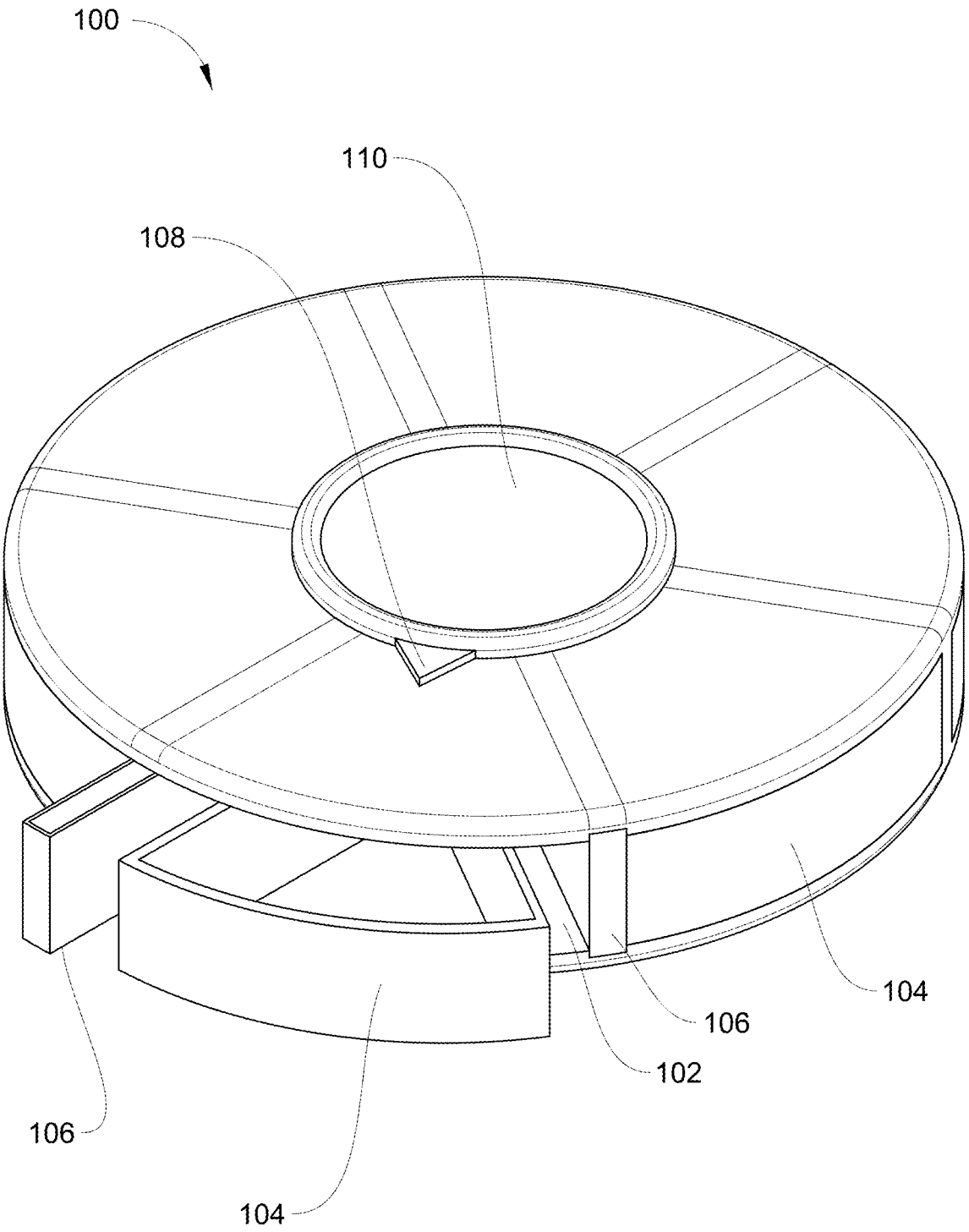
FIG. 2 shows a perspective view of the system of FIG. 1, in accordance with another embodiment of the present disclosure.

Referring to FIG. 2, there is shown a perspective view of the system 100 of FIG. 1, in accordance with another embodiment of the present disclosure. As shown, the rotatable selector 108 has been used to select a cartridge 200 and a respective applicator 202. Further, operation of the dispenser 110 has caused movement of the cartridge 202 from the first position proximally to the center of the housing 102 (associated with position of the dispenser 110) as well as extension of the applicator 202 from the cartridge 202 to enable application of the cosmetic product stored within the cartridge 202.

I claim:

1. A system (100) to dispense cosmetic products, the system (100) comprising: a housing (102);

a plurality of individual cartridges (104) disposed within a periphery of the housing (102), wherein each individual cartridge (104) receives a cosmetic product and wherein the each individual cartridge (104) is selectively movable between a first position proximally to a center of the housing (102) and a second position proximally to the periphery of the housing (102);

a plurality of applicators (106), wherein each applicator (106) is connected to the individual cartridge (104) of the plurality of individual cartridges (104) to enable application of the cosmetic product stored in the each individual cartridge (104);

a rotatable selector (108) disposed proximally to a center of the housing (102), wherein the rotatable selector (108) enables selection of the each individual cartridge (104) from the plurality of individual cartridges (104);

a dispenser (110) disposed at the center of the housing (102); wherein the dispenser (110) is connected to the each individual cartridge (104) and the rotatable selector (108) and wherein operation of the dispenser (110) enables movement of the each individual cartridge (104) selected using the rotatable selector (108) between the first position and the second position;

wherein the each individual cartridge (104) of the plurality of individual cartridges (104) is detachably received into the housing (102); and wherein the housing (102) comprises a plurality of receptacles to receive the plurality of individual cartridges (104) and wherein: the each individual cartridge (104) comprises a first snap-fit lock; and each receptacle comprises a second snap-fit lock, wherein the first snap-fit lock engages with the second snap-fit lock to receive the each individual cartridge (104) into the respective receptacle.

2. The system (100) of claim 1, wherein the each individual cartridge (104) is associated with a different cross-section.

3. The system (100) of claim 1, wherein the cosmetic product is one of: a liquid cosmetic product, a semi-solid cosmetic product, a powder-based cosmetic product.

4. The system (100) of claim 1, wherein the plurality of applicators (106) comprise at least one of: a tube-type applicator, a sponge-type applicator, a brush-type applicator.

5. The system (100) of claim 1, wherein the each applicator (106) is detachably connected to the each individual cartridge (104) through a spill-proof valve.

6. The system (100) of claim 1, wherein the dispenser (110) is one of: a push button, a slider.

7. The system (100) of claim 1, wherein the dispenser (110) comprises a mirror thereon and wherein the mirror comprises a slidable cover.

8. The system (100) of claim 7, wherein the movement mechanism is implemented using one of: a rail guide, a linear bearing, a dovetail slide, a rack and pinion arrangement.

9. The system (100) of claim 1, wherein the system (100) comprises a movement mechanism connected to the each individual cartridge (104), the rotatable selector (108) and the dispenser (110) and wherein the movement mechanism enables movement of selected of the each individual cartridge (104) between the first position and the second position upon selection using the rotatable selector (108) and activation of the dispenser (110).

10. The system (100) of claim 1, wherein the each applicator (106) is stored in a retracted state with respect to the each individual cartridge (104) when a respective of the each individual cartridge (104) is in the first position and wherein the each applicator (106) is released when the each individual cartridge (104) is moved to the second position.

* * * * *